United States Patent [19]

Moreau

[11] Patent Number: 4,671,190

[45] Date of Patent: Jun. 9, 1987

[54] FIRE GRATE

[75] Inventor: André Moreau, Paris, France

[73] Assignee: Electricite de France (Service National), Paris, France

[21] Appl. No.: 802,451

[22] Filed: Nov. 27, 1985

[30] Foreign Application Priority Data

Nov. 30, 1984 [FR] France ..... 84 18269

[51] Int. Cl.[4] ..... F23H 7/08

[52] U.S. Cl. ..... 110/281; 110/328; 126/163 A; 126/174; 34/164

[58] Field of Search ..... 110/278–283, 110/288, 291, 328, 289, 300; 34/164; 126/163, 152 R, 176 R, 176 A, 179, 174, 175, 167; 432/134, 80

[56] References Cited

U.S. PATENT DOCUMENTS

| | | | |
|---|---|---|---|
| 2,250,067 | 7/1941 | Martin | 110/282 |
| 2,701,537 | 2/1955 | Martin | 110/328 |
| 2,846,778 | 8/1958 | Markle, Jr. | 34/164 |
| 3,508,535 | 4/1970 | Martin et al. | 126/163 |
| 3,624,920 | 12/1971 | Coutelan | 34/164 |
| 4,494,469 | 1/1985 | Pinto | 110/281 |
| 4,510,873 | 4/1985 | Shigaki | 110/282 |
| 4,515,560 | 5/1985 | Jacquemin et al. | 34/164 |

FOREIGN PATENT DOCUMENTS

| | | |
|---|---|---|
| 6905562 | 2/1969 | Fed. Rep. of Germany . |
| 2148387 | 3/1972 | Fed. Rep. of Germany . |
| 1006739 | 4/1952 | France . |
| 1567605 | 5/1969 | France . |
| 2519738 | 7/1983 | France . |
| 2526921 | 11/1983 | France . |

*Primary Examiner*—James C. Yeung

*Attorney, Agent, or Firm*—Charles E. Brown; Charles A. Brown

[57] ABSTRACT

A fire grate is adapted to support a combustible mass. It is inclined longitudinally from a feed end at which it receives the combustible mass to a discharge end. It comprises a plurality of elements disposed in transverse rows alternately fixed and mobile. Each element is rectangular in plan and has a top side and a bottom side, openings by means of which the top side and the bottom side communicate, and a generally transversely oriented front protuberance on the top side in the vicinity of its transverse edge at the feed end. All the openings are in a dorsal surface of the front protuberance facing the discharge end.

21 Claims, 5 Drawing Figures

FIRE GRATE

BACKGROUND OF THE INVENTION

1. Field of the invention

The present invention concerns a fire gate adapted to support the combustible mass in a furnace, in particular a furnace for incinerating waste. The present invention also concerns the individual elements which constitute the grate.

2. Description of the prior art

Known combustible mass supporting grates are generally of the type comprising a plurality of identical individual elements. These grates are generally inclined so that the combustible mass tipped onto one end progresses along the slope. To achieve this, and also to obtain good distribution of the combustible mass along the grate, it is generally necessary to agitate the mass.

This agitation is generally achieved by movement of the individual grate elements, which are displaced relative to one another. Sharp projections or some special arrangement (staircase fashion, for example) enables the elements to modify the surface of the grate by virtue of their respective movements. Agitation is achieved in this way.

A grate of this kind is described in particular in document No. FR-A-1567605 (J. Martin).

In other implementations the elements are adapted to feed air into the combustible mass. Reference may be had in particular to French patent No. 1 006 739 describing an air communication system created between adjacent elements on relative longitudinal displacement thereof.

The main problem in incinerating products such as waste stems from the release of sulfides which tend to create deposits because their melting point is lower than that of their oxidation product. They are also the main contributors to making the environment extremely corrosive, which tends to create problems with regard to the service life of the incineration installation as a whole. It is therefore important to promote the conversion of these sulfides (in particular CaS, Na2S, FeS) into the corresponding solid oxides or sulfates and to adjust the combustion conditions accordingly to provide as regular and as complete combustion as possible.

The support grate elements are thus generally provided with orifices enabling the primary air blown in beneath the grate to supply oxygen for combustion.

Grate elements of this kind are known from document No. DE-U-6 905 562 (C. PETERS AG).

However, grates formed of elements with very many holes passing through them do not provide for correct control of the quantity of primary air introduced.

This is important since excess primary air is no more favorable to good combustion than any deficiency thereof.

The problem which arises is the clogging of the air feed orifices by the sulfide deposits themselves, or by as yet unburned elements of the combustible mass. This modifies the oxygen feed in a random manner, which affects the combustion.

A second problem which arises is that created by the raising of the mobile elements, which may be due to the accidental inclusion between two elements of some waste. The raising of an element has two effects: it changes the oxygen input, and it enables an element to penetrate under the grate, possibly into the primary air feed means. Increasing the weight of each element would enable this disadvantage to be obviated, but other problems would then arise, of construction in particular.

Another problem which arises is that of abnormal heating of the elements: in the event of blocking of the orifices enabling air to pass through an element, the element heats up abnormally, with all the implicit consequences: rapid deterioration and/or excessive thermal expansion resulting in binding against the adjacent elements.

A further difficulty results from the excessive quantity of flying ash which may be produced, causing rapid soiling of the parts of the incineration installation situated above the hearth.

The object of the present invention is to propose a new fire grate able to alleviate these disadvantages.

SUMMARY OF THE INVENTION

The present invention consists in a fire grate adapted to support a combustible mass, inclined longitudinally from a feed end at which it receives said combustible mass to a discharge end and comprising a plurality of elements disposed in transverse rows alternately fixed and mobile each of which elements is rectangular in plan and has a top side and a bottom side, openings by means of which said top side and said bottom side communicate, and a generally transversely oriented front protuberance on said top side in the vicinity of its transverse edge at the feed end, wherein all said openings are in a dorsal surface of said front protuberance facing the discharge end.

In this way numerous advantages are combined to achieve the best possible conditions for combustion of the waste:

The relative to-and-fro movement of the transverse rows implies the same movement of the front protuberances, which thus procures continuous agitation and overturning of the waste.

The disposition of the orifices on the dorsal surface prevents the orifices being blocked by the waste during the agitation thereof.

Thus the circulation of air from beneath to above the grate is achieved without being adversely affected by agitation of the combustible mass.

In this way the combustion conditions ensure increased efficiency, which makes it possible to reduce the speed of relative displacement of the rows and thus to reduce wear of the grate.

In accordance with another aspect of the invention, the orifices are the only means of communication of air between the bottom and top of the grate.

Thus it is possible to determine the quantity of primary air introduced into the combustible mass in order to realize the best possible combustion conditions.

According to another aspect of the invention, all the elements of the same transverse row are fastened together and laterally contiguous.

This makes it possible to avoid the raising of an individual element by virtue of the total mass of an entire row thus fastened together.

Other characteristics and advantages of the invention will emerge from the following description of a preferred embodiment of the invention shown by way of non-limiting example in the appended drawings.

DESCRIPTION OF THE PREFERRED EMBODIMENT

Figure 1:
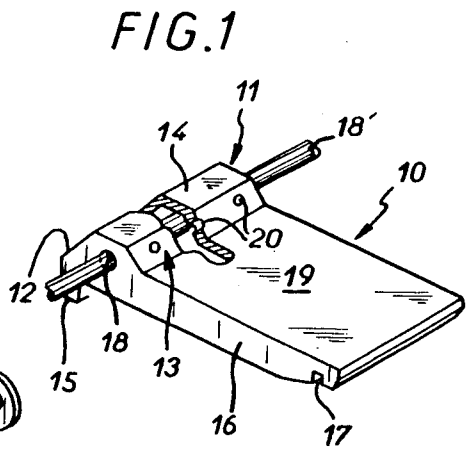
FIG. 1 is a partially cut away view in perspective of a grate element in accordance with the invention.
Figure 2:
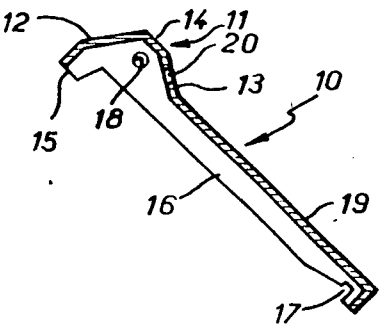
FIG. 2 is a view of a grate element in accordance with the invention in longitudinal cross-section.

The individual element 10 shown in FIGS. 1 and 2 consists of a part which is of generally rectangular shape in plan view, comprising an anterior part consisting of a so-called front protuberance 11 projecting from its upper surface and having a so-called front face 12 inclined towards the front, a flat summit 14 and a so-called dorsal surface 13 inclined towards the rear.

This protuberance, of constant transverse cross-section, extends across the full width of the element 10.

Behind this front protuberance the element features a flat-topped part 19. A transverse groove 17 is formed beneath the element in the immediate vicinity of its posterior edge and parallel thereto.

A bearing rim 15 is constituted by the thickness of the wall of the element at its anterior and constituted by a downward projection of the front surface 12.

This projection being substantially perpendicular to the general plane of the element 10, the bearing rim is substantially parallel to this plane.

The thickness of the element is constant in the embodiment shown. Thus to the protuberance on the top side corresponds a recess in the bottom side, also having a front surface, a dorsal surface and a bottom linking these two surfaces. Two substantially plane lateral cheeks 16 project from the bottom surface at the edges of the element. These cheeks feature openings 18 vertically aligned with the flat summit 14 of the protuberance 11.

Figure 5:
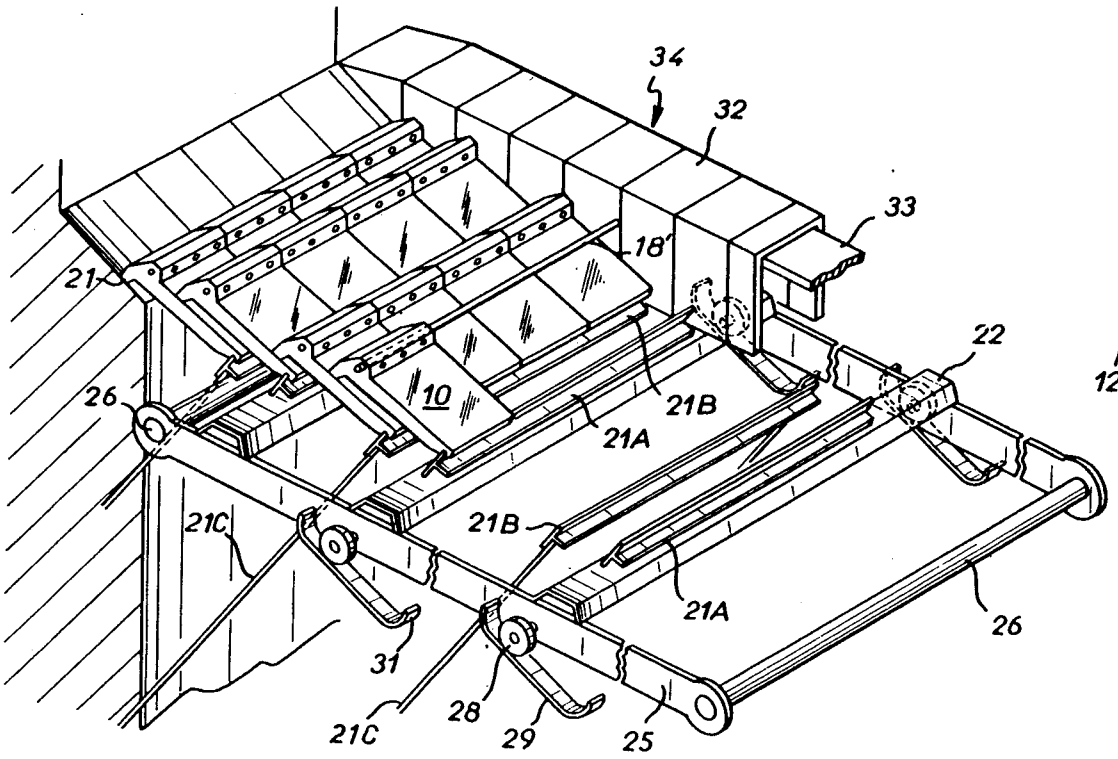
FIG. 5 is a view in perspective of a grate in accordance with the invention from which a number of elements have been removed.

The two openings 18 are symmetrical relative to a median longitudinal plane of the element 10 and provide for the passage of a rod 18' which locks together adjacent elements of the grate (FIG. 5).

Three openings 20 of precise dimensions pass through the wall forming the dorsal surface 13 of the projection 11, in a direction substantially perpendicular thereto.

Figure 3:
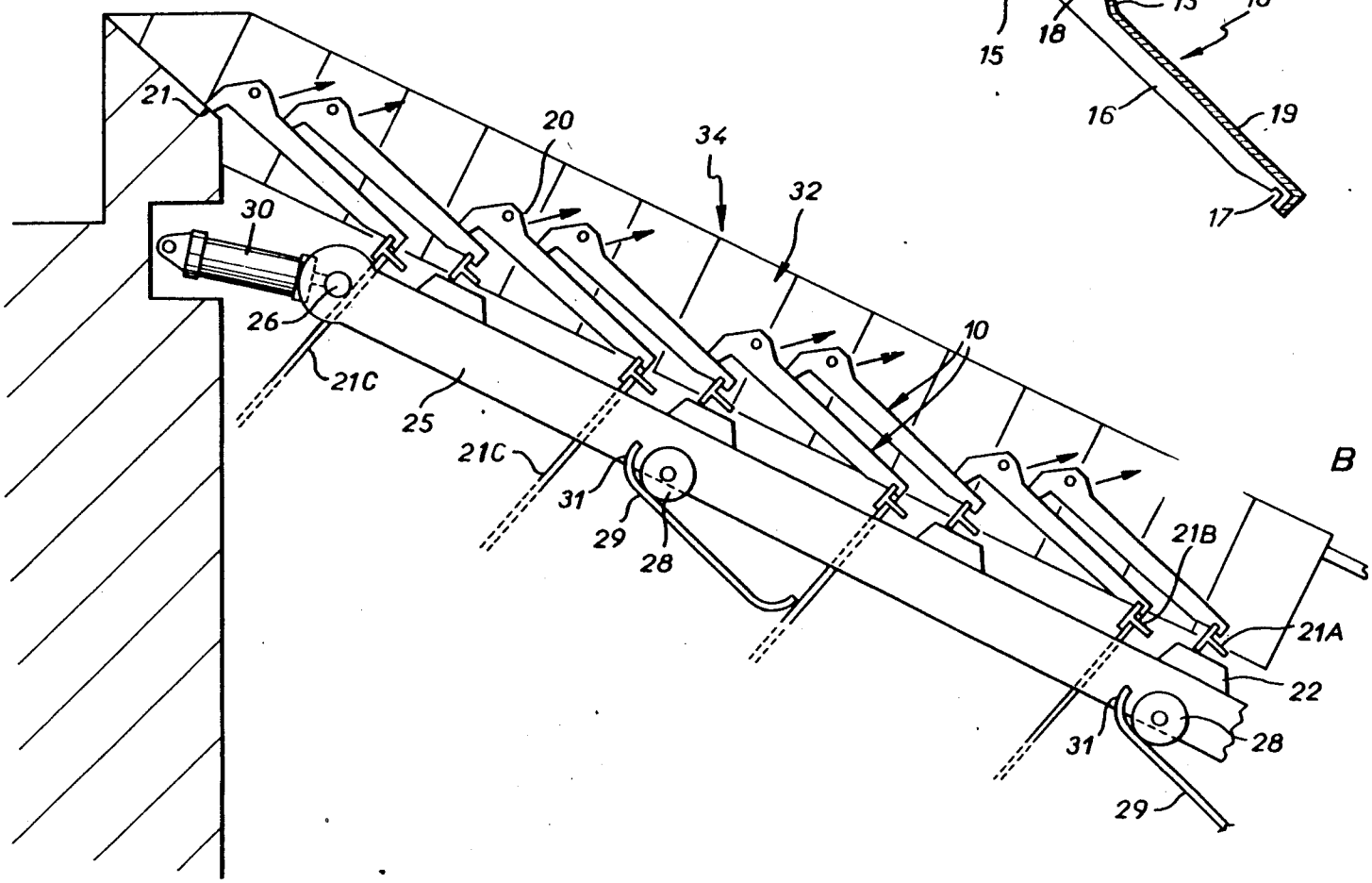
FIGS. 3 and 4 are views in lateral elevation of a grate in accordance with the invention, the mobile rows being respectively in the high and low position.
Figure 4:
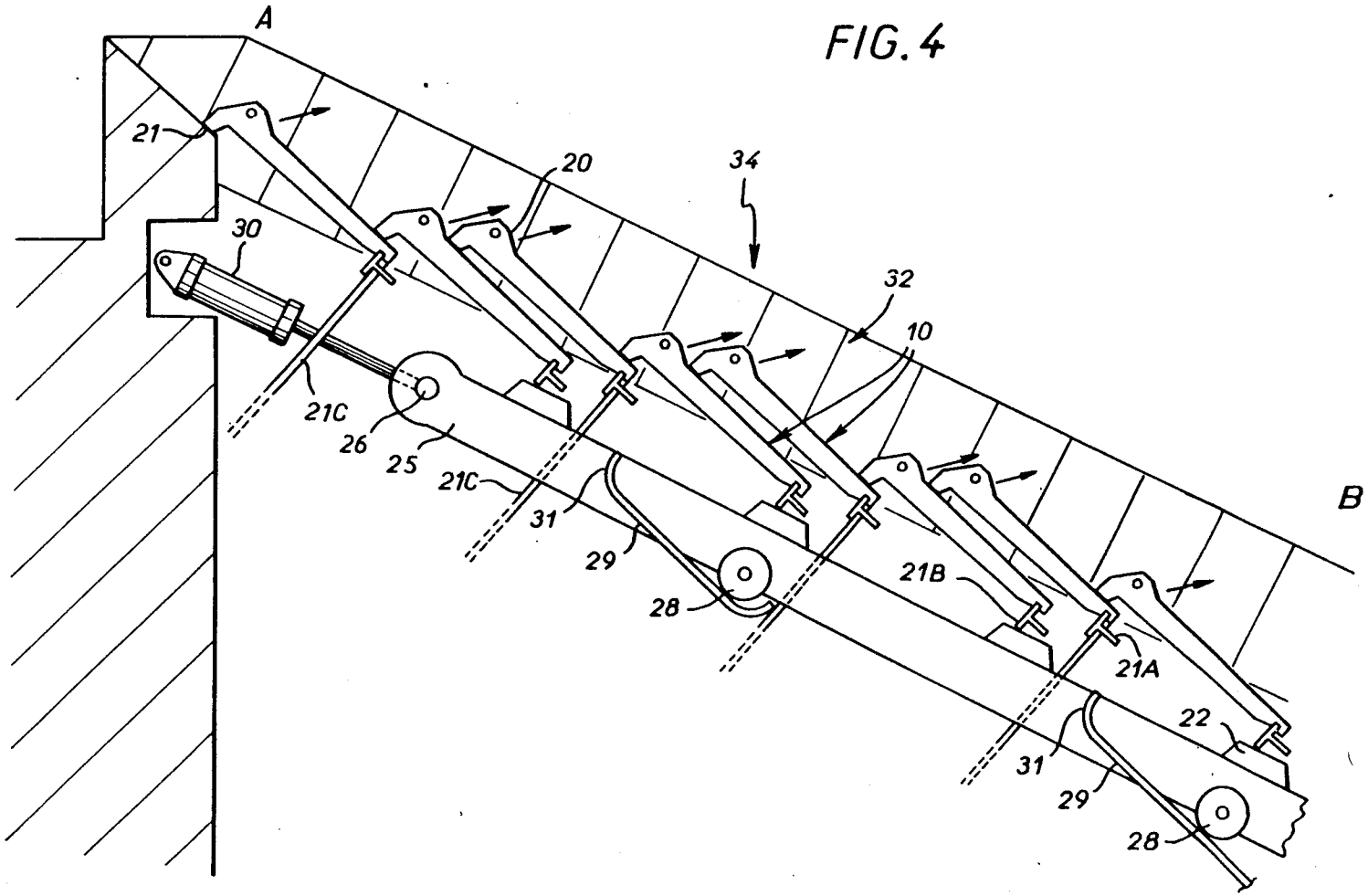

FIGS. 3 and 4 show a fire grate in accordance with the invention made up of elements 10.

Generally speaking, the grate comprises a so-called feed end A, at which the waste constituting the combustible mass is delivered, and a so-called discharge opposite end B, situated at a lower level.

In practice, when disposed in the grate, the so-called front parts of each element face towards the feed end and the so-called dorsal parts face towards the discharge end.

The grate is made up of two parts, one fixed and the other mobile.

The mobile part comprises a structure forming a frame consisting of two parallel beams 25 linked together by at least two crossmembers such as 26. The beams 25 rest on inclined planes 29 through the intermediary of rollers 28. These rollers are mounted on shafts fastened to the beams 25, enabling them to roll on the corresponding inclined planes. The beams 25 feature at regular intervals bosses 22 projecting from their upper part. To these bosses are fixed support crossmembers 21A of T-shaped cross-section laid on the side.

The fixed part comprises a structure made up of support crossmembers 21B similar to the crossmembers 21A and parallel to them. The support crossmembers 21B are fixed by oblique bars 21C fastened to the body of the hearth.

The elements 10 bear on the support crossmembers 21A, 21B through their posterior grooves 17 and on the top surface of the preceding element through the rim 15. The elements 10 are thus disposed contiguously in parallel rows, each row bearing simultaneously on a support crossmember 21A or 21B and on the preceding row, like roof tiles.

The first row bears on a fixed support crossmember 21B and on a structure support 21 formed for this purpose in the body of the hearth.

An actuator 30 is fixed to the anterior crossmember 26, providing for to-and-fro displacement of the structure forming the frame of the mobile part with a direction and amplitude of displacement determined by the inclined planes 29. The amplitude of such displacement is limited by abutment members 31 provided on the inclined planes 29. The mobile structure being fastened to the rows of elements 10 that it supports, all of the mobile part move with the to-and-fro movement communicated by the actuator 30.

The grate is bordered at the sides (FIG. 5) by two U-shaped cross-section casing members 34 which overlay the rollers 28 and the inclined planes 29. Their lateral edges are contiguous with the cheeks 16 of the immediately adjacent elements 10. These casing members 34 consist of a succession of stirrup-shaped members 32 resting on a longitudinal member 33. A grate may also be made up of a number of sets of rows of elements 10, each set being separated from the adjacent set by a casing member 34.

The function of these casing members is to avoid any uncontrolled communication of air between the bottom and top of the grate.

When the waste is tipped so as to fall onto the first rows of elements of the grate, the to-and-fro movement of the mobile rows resting on the fixed rows agitates the waste. The front protuberances 11, by virtue of this to-and-fro movement, agitate the mass of waste, which is set alight. The inclination of the grate causes the waste to progress slowly under its own weight along the grate, from the feed end to the discharge end.

The fastening together by the rod 18' of the adjacent elements in a row prevents any individual raising of elements due to possible inclusion of waste: as all elements are fastened together, any such inclusion would involve raising the entire row, which is prevented by its weight.

The rearwardly inclined surfaces 13 of the protuberances 11 are, by virtue of the inclination of the grate, in a position at an angle of approximately 15° to the vertical. This prevents the waste or the combustion products collecting on said surfaces. Thus the orifices 20 remain unblocked.

Being directly in contact with the mass of waste, these orifices provide for the local feed of primary air necessary for good combustion. The primary air is supplied by a blower situated under the grate. As the elements 10 are contiguous, the primary air is obliged to pass only through the orifices 20, so that the flowrate can be controlled, and the orientation of the orifices 20 determines that of the jets of primary air which pass through the grate. This orientation at approximately 15° to the horizontal is important given that the air jets tend to volatilize the ash which, if these jets were in a direction nearer the vertical, would tend to rise and soil the upper structures of the hearth. The orientation of these jets enables this disadvantage to be avoided.

The advantages of the invention make it possible to reduce the phenomenon of volatilization of the incandescent ash and thus to reduce consequent deposits on the upper structure of the hearth and to achieve improved combustion by virtue of a regular input of primary air, and therefore to improve efficiency as well as to reduce corrosion due to sulfides.

Also, improved combustion makes it possible to reduce the rate of agitation of the combustible mass and thus of sliding of the elements over one another. This reduces wear.

Other embodiments may be implemented without departing from the scope of the invention. For example, the rows of contiguous individual elements may be replaced by single elements, made from profiled section, each element extending over a greater or lesser part or even the entire width of the grate.

There is claimed:

1. A furnace construction for a combustible mass, said furnace construction comprising a fire grate for supporting a combustible mass during burning of such combustible mass, said fire grate being inclined downwardly longitudinally from a combustible mass feed end to a discharge end, said fire grate including a plurality of like elements disposed in plural transverse rows, support means mounting said transverse rows alternatingly in fixed and longitudinally mobile positions, each of said elements being rectangular in plan and having top and bottom sides, said top side having a generally planar major surface portion inclined downwardly longitudinally towards said fire grate discharge end, said element having a feed end transverse edge and a discharge end transverse edge, a generally transversely oriented front protuberance on said top side adjacent said feed end transverse edge, said front protuberance having a dorsal surface generally facing said fire grate discharge end, and openings for combustion supporting air through said dorsal surface from said bottom side to said top side, said openings extending generally horizontally as opposed to vertically.

2. A furnace construction according to claim 1, wherein said openings are the only means for communication of air between the bottom and top of said fire grate.

3. A furnace construction according to claim 1, wherein said elements have longitudinal flanks, and there are means fastening together all of said elements in the same transverse row, and said elements are contiguous via said flanks.

4. A furnace construction according to claim 1, wherein said openings constitute parallel conduits longitudinally oriented at a small angle above the horizontal in a direction from beneath said grate to above said grate.

5. A furnace construction according to claim 4, wherein said small angle is on the order of 15°.

6. A furnace construction according to claim 4 wherein said conduits are normal to said dorsal surfaces.

7. A furnace construction according to claim 1, wherein each element comprises a generally transverse bearing rim having an anterior edge forming an anterior edge of said element, said bearing rim being slidable on said planar surface of that element corresponding to said element in an immediately anterior row.

8. A furnace construction according to claim 1, wherein each of said mobile elements has a lower surface in the immediate vicinity of said discharge end transverse edge, a downwardly opening groove in said lower surface, and a mobile support crossmember on which said grooves rest, a structure forming a frame to which all said mobile support crossmembers are fastened, and actuator means coupled to said frame.

9. A furnace construction according to claim 8, wherein said mobile elements have bearing rims, and the movement communicated to said support crossmembers by said actuator means is a to-and-fro movement such that said bearing rims slide alternately forwards and backwards on an upper surface of an immediately anterior element.

10. A furnace construction according to claim 1, wherein each transverse row is made up of a single profiled element.

11. A fire grate for supporting a combustible mass during combustion thereof, the fire grate being inclined downwardly longitudinally from a combustion mass feed end to a discharge end, the fire grate including a plurality of like elements disposed in plural transverse rows, support means mounting said transverse rows alternatingly in fixed and longitudinally mobile positions, each of said elements being rectangular in plan and having top and bottom sides, said top side having a generally planar major surface portion inclined downwardly longitudinally towards said fire grate discharge end, said element having a feed end transverse edge and discharge end transverse edge, said feed end transverse edge being engageable with the planar surface portion of an immediately upstream and subjacent one of said elements, a generally transversely oriented front protuberance on said top side adjacent said feed end transverse edge, said front protuberance having a dorsal surface generally facing said fire grate discharge end, openings for combustion supporting air, said openings all extending through said dorsal surface from said bottom side to said top side, openings angling upwards but lying closer to the horizontal direction than the vertical direction.

12. A fire grate according to claim 11, wherein said openings are the only means for communication of air from said bottom side to said top side of the fire grate.

13. A fire grate according to claim 11, wherein said elements have longitudinal flanks, means fastening said elements of the respective transverse rows together, said elements of the respective rows being contiguous along their longitudinal flanks.

14. A fire grate according to claim 11, wherein said openings constitute parallel passageways oriented longitudinally at a small angle above the horizontal.

15. A fire grate according to claim 14, wherein said small angle is of the order of 15°.

16. A fire grate according to claim 14, wherein said passageways are normal to their respective dorsal surfaces.

17. A fire grate according to claim 11, wherein each of said elements comprises a generally transversely bearing rim including said feed end transverse edge, said bearing rim being slidable on said planar surface portion of the immediately upstream and subjacent one of said elements.

18. A fire grate according to claim 11, wherein each of said mobile elements has a downwardly opening groove in its bottom surface in the immediate vicinity of said discharge transverse edge, said groove being received on a mobile support crossmember, all said mobile support crossmembers being fastened to a frame means, and actuator means being coupled to said frame means.

19. A fire grate according to claim 18, wherein said mobile elements have bearing rims including discharge end transverse edges, and said support crossmembers being reciprocably movable in response to said actuator means such that said bearing rims slide forwards and backwards on the planar surface portion of the corresponding immediately upstream and subjacent one of said fixed elements.

20. A fire grate according to claim 11, wherein each of said transverse rows of the fire grate comprises a single said element.

21. A fire grate according to claim 11, wherein said elements are of substantially constant wall thickness.

* * * * *